US011034911B2

(12) United States Patent
Ranney

(10) Patent No.: US 11,034,911 B2
(45) Date of Patent: Jun. 15, 2021

(54) OIL ADDITIVE

(71) Applicant: Ever Gard, LLC, Ixonia, WI (US)

(72) Inventor: Ryan Ranney, Hartland, WI (US)

(73) Assignee: Ever Gard, LLC, Ixonia, WI (US)

( * ) Notice: Subject to any disclaimer, the term of this patent is extended or adjusted under 35 U.S.C. 154(b) by 16 days.

(21) Appl. No.: 16/510,105

(22) Filed: Jul. 12, 2019

(65) Prior Publication Data

US 2020/0017796 A1 Jan. 16, 2020

Related U.S. Application Data

(60) Provisional application No. 62/696,998, filed on Jul. 12, 2018.

(51) Int. Cl.

| | |
|---|---|
| ***C10M 125/10*** | (2006.01) |
| ***C10M 125/26*** | (2006.01) |
| ***C10M 169/04*** | (2006.01) |
| ***C10M 141/08*** | (2006.01) |
| ***C10M 129/40*** | (2006.01) |
| ***C10M 159/00*** | (2006.01) |
| ***C10M 133/08*** | (2006.01) |
| ***C10M 135/10*** | (2006.01) |
| ***C10M 129/08*** | (2006.01) |
| ***C10M 163/00*** | (2006.01) |
| *C10N 20/00* | (2006.01) |
| *C10N 30/04* | (2006.01) |
| *C10N 40/25* | (2006.01) |

(52) U.S. Cl.

CPC ..... *C10M 169/045* (2013.01); *C10M 125/10* (2013.01); *C10M 125/26* (2013.01); *C10M 129/08* (2013.01); *C10M 129/40* (2013.01); *C10M 133/08* (2013.01); *C10M 135/10* (2013.01); *C10M 141/08* (2013.01); *C10M 159/005* (2013.01); *C10M 163/00* (2013.01); *C10M 2201/062* (2013.01); *C10M 2201/087* (2013.01); *C10M 2203/003* (2013.01); *C10M 2207/022* (2013.01); *C10M 2207/126* (2013.01); *C10M 2215/26* (2013.01); *C10M 2219/044* (2013.01); *C10N 2020/071* (2020.05); *C10N 2030/04* (2013.01); *C10N 2040/25* (2013.01)

(58) Field of Classification Search

CPC ..... C10M 125/10; C10M 125/26
USPC ..... 508/156, 158, 160, 154, 165, 175–178
See application file for complete search history.

(56) References Cited

U.S. PATENT DOCUMENTS

| | | | | |
|---|---|---|---|---|
| 5,385,683 | A * | 1/1995 | Ransom | C10M 165/00 508/181 |
| 5,576,273 | A * | 11/1996 | Karol | C10M 141/08 508/364 |
| 6,294,507 | B1 | 9/2001 | Dahl | |
| 6,429,175 | B1 * | 8/2002 | Stuart, Jr. | C10M 169/00 508/144 |
| 2007/0154128 | A1 * | 7/2007 | Mikami | F16C 33/6611 384/627 |

(Continued)

*Primary Examiner* — Ellen M McAvoy
(74) *Attorney, Agent, or Firm* — Quarles & Brady LLP

(57) ABSTRACT

Disclosed herein is an oil additive and combination oil product comprising an effective amount of the oil additive. The oil additive comprises a bismuth-containing premix, the bismuth-containing premix comprising bismuth trioxide and a carrier, and a boron-containing premix, the boron-containing premix comprising boric acid, a carrier, and an anionic surfactant.

20 Claims, 1 Drawing Sheet

(56) References Cited

U.S. PATENT DOCUMENTS

| | | | | |
|---|---|---|---|---|
| 2008/0196995 | A1* | 8/2008 | Mikami | C10M 169/00<br>192/41 R |
| 2009/0048129 | A1* | 2/2009 | Mabuchi | C10M 125/02<br>508/172 |
| 2010/0152076 | A1* | 6/2010 | Malmstedt | C10M 133/56<br>508/158 |
| 2011/0015104 | A1* | 1/2011 | Olliges | C10M 169/04<br>508/160 |
| 2012/0108475 | A1* | 5/2012 | Lindblom | C10M 125/26<br>508/156 |
| 2014/0031267 | A1* | 1/2014 | Von Knorring | C10M 125/20<br>508/156 |
| 2016/0075963 | A1* | 3/2016 | Simonetti | C10M 141/12<br>508/156 |
| 2016/0186083 | A1* | 6/2016 | White | C10M 129/40<br>508/158 |

* cited by examiner

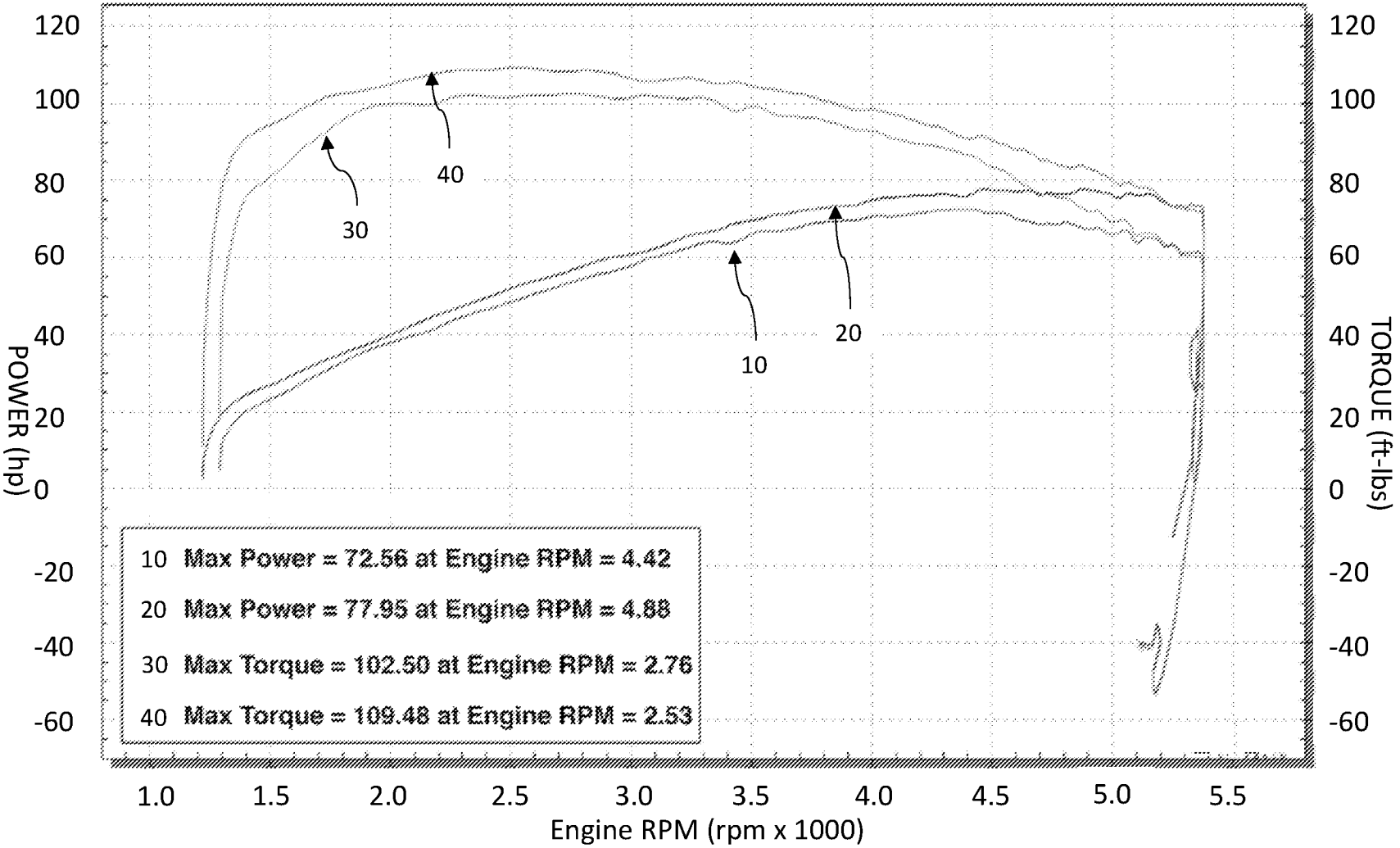
TORQUE (ft-lbs)
120
100
80
60
40
20
0
-20
-40
-60
POWER (hp)
1.0
1.5
2.0
2.5
3.0
3.5
4.0
4.5
5.0
5.5
Engine RPM (rpm x 1000)
10
20
30
40
10 Max Power = 72.56 at Engine RPM = 4.42
20 Max Power = 77.95 at Engine RPM = 4.88
30 Max Torque = 102.50 at Engine RPM = 2.76
40 Max Torque = 109.48 at Engine RPM = 2.53

OIL ADDITIVE

CROSS-REFERENCE TO RELATED APPLICATIONS

This application claims the benefit of priority to U.S. Provisional Application No. 62/696,998, filed Jul. 12, 2018, the contents of which is incorporated by reference.

FIELD OF INVENTION

The technology is generally directed to oil additives. More specifically the technology is directed to oil additives comprising bismuth- and boron-containing premixes.

BACKGROUND

Lubricating oils, such as motor oil, transmission fluid, gear oil, hydraulic fluid and the like, generally include one or more additives, which are designed to enhance certain physical properties of the oil. For example, sulfur and chlorine compounds are frequently added to lubricating oil to increase its film strength. However, water or moisture resulting from condensation can accumulate in the oil and react with the sulfur or chlorine compounds to produce acidic components, which can cause corrosion of the lubricated parts. To counteract the corrosive effect of the acidic components, caustic materials are often added to the oil, but the caustic materials in themselves can produce a corrosive atmosphere.

Lubricating oils are frequently subjected to extreme temperatures in service which can range from about −50° F. to 400° F. In order to provide the oil with a desired viscosity at the normal running temperature, the oil at the start-up of operation may be required to have a high viscosity, which tends to produce improper lubrication until the oil temperature is increased as the mechanism is operated. In an attempt to eliminate this problem viscosity stabilizers have been incorporated in lubricating oil such those described in U.S. Pat. No. 6,294,507. Although it is known that bismuth provides excellent lubricating properties, the carrying compounds used with it were unstable in oil and resulted in the product salting out over unsuitably short periods. This renders the oil additive unsuitable for oil service. As a result, there is a need for new oil additives that provide excellent lubricating properties that remain stable over long shelf lives and service periods.

BRIEF SUMMARY OF THE INVENTION

Oil additives and combination oil products comprising the oil additive are disclosed herein. The oil additive comprises a bismuth-containing premix, the bismuth-containing premix comprising bismuth trioxide and a bismuth carrier, and a boron-containing premix, the boron-containing premix comprising boric acid, a boron carrier, and an anionic surfactant. In some embodiments, the oil additive further comprises a component selected from the group consisting of a shear stable polymer, a dispersing agent, a base oil, a carboxylic acid for adjusting the total acid number, a glycol, and any combination thereof. In certain embodiments, the oil additive comprises a shear stable polymer, a dispersing agent, a base oil, a carboxylic acid for adjusting the total acid number, and, optionally, a glycol.

Combination oil products comprising an effective amount of any of the oil additives described above are also disclosed.

BRIEF DESCRIPTION OF THE DRAWINGS

Non-limiting embodiments of the present invention will be described by way of example with reference to the accompanying FIGURES, which are schematic and are not intended to be drawn to scale. In the FIGURES, each identical or nearly identical component illustrated is typically represented by a single numeral. For purposes of clarity, not every component is labeled in every FIGURE, nor is every component of each embodiment of the invention shown where illustration is not necessary to allow those of ordinary skill in the art to understand the invention.

The FIGURE shows the output power and torque from a motorcycle engine running.

DETAILED DESCRIPTION OF THE INVENTION

The invention is directed to an oil additive to be added to oil, particularly lubricating oils, to improve the physical properties of the oil during service. The additive of the invention is a homogeneous liquid comprising, in general, the combination of a bismuth-containing premix (BiP) and a boron-containing premix (BP) in a refined oil. In motor oil, the additive improves engine performance, resulting in an increase in engine horsepower and/or torque, and a reduction in engine temperature. The additive may also improve fuel efficiency, reduce emissions, reduce engine corrosion and/or wear, or reduce the frequency of oil changes.

The particular formulation advantageously prevents the oil additive and combination oil products from separating, coagulating, or precipitating over extended periods of time. As a result, the oil additive and combination oil products comprising the oil additive are self-stable over months or more.

As used herein, a "combination oil product" is a composition comprising a base oil and an effective amount of the oil additive. An "effective amount" is an amount of the oil additive that results in improvement in base oil's properties or performance. For example, an effective amount of the oil additive may result in improved horsepower, improved torque, reduction in engine temperature, improved fuel efficiency, reduction in engine emissions, or reduction in engine corrosion and/or wear.

Combination oil products containing the additive have excellent film strength. The combination oil product may provide a boundary layer of lubrication between two moving parts. Due to its high Timken rating, which is the load carrying pressure required to break the oil film and provide metal-to-metal contact, the use of the oil containing the additive substantially increases the service life of the lubricated equipment.

The additive also provides the combination oil product with excellent "wash-out" features, making it difficult to remove from a metal surface. The composition of the additive comprises polar components, giving it a high affinity for metal surfaces, which then significantly and rapidly dissipates heat caused by friction. The combination oil product containing the additive of the invention will substantially reduce the operating temperature of the oil. This cooling effect results in the viscosity of the oil staying higher than normal, providing increased boundary lubrication.

Bismuth-containing oil additives for improving the physical properties of the oil during service have been previously disclosed. These additives typically suffer from instability, resulting in the components separating, coagulating, or precipitating over time. This renders the oil additive and combination oil products unsuitable for extended service and, even, extended shelf life. The present additive provides an improvement over prior additives in that it provides improved physical properties of the oil while also providing extended shelf life and service stability. The additive comprises a combination of a BiP and a BP.

The BiP comprises a bismuth component, suitably introduced as bismuth trioxide and a bismuth carrier. The bismuth carrier comprises a carboxylic acid, a conjugate base thereof (i.e., the corresponding carboxylate), or a combination thereof. The carboxylic acid may be a linear or branched, saturated or unsaturated $C_6$-$C_{16}$ carboxylic acid, a conjugate base thereof, or a combination thereof. In some embodiments, the carboxylic acid is selected from a linear or branched, saturated or unsaturated $C_7$-$C_{10}$ carboxylic acid. Suitably the carboxylic acid comprises one or more of heptanoic acid, octanoic acid, and neodecanoic acid.

The BiP may comprise between about 1% and about 50% of the bismuth component by weight. This includes between about 5% and about 40% of the bismuth component by weight or between about 15% and about 30% of the bismuth component by weight. The balance of the BiP may be the carrier.

Concentrated oil additives may comprise between about 50% and about 99% of the BiP by weight, but the amount of BiP by weight may be lower when diluted with a base oil. Suitably, the oil additive may comprise between about 55% and about 90% of the BiP by weight or about 60% and about 80% of the BiP by weight.

When the BiP comprises the conjugate base of a carboxylic acid, the BiP also comprises a counterion. For the purposes of determining weight percentages of the bismuth component and carrier, the weight of the counterion is included with the carrier.

The BP comprises a boron component, suitably introduced as boric acid, a borate ester, or a polymeric borate ion such as triborate, tetraborate, or pentaborate. The BP further comprises a boron carrier. The boron carrier may comprise one or more of an alkanolamine; a medium- or long-chain carboxylic acid or a conjugate base thereof; an alkanolamide; or any combination thereof. The BP may also comprise an anionic surfactant, The alkanolamine comprises a compound of formula $NRR^1R^2$. R, $R^1$, and $R^2$ may be independently selected from hydrogen, alkanol groups, or alkyl groups so long as at least one of R, $R^1$, and $R^2$ is an alkanol group. Suitably, R may comprise a $C_1$-$C_4$ alkanol group and $R^2$ and $R^3$ may be independently selected from hydrogen, a $C_1$-$C_4$ alkyl group, or a $C_1$-$C_4$ alkanol group. Suitably the alkanolamine is a monoalkanolamine such as monoethanolamine.

The branched or unbranched, saturated or unsaturated medium- or long-chain carboxylic acid may be a $C_8$-$C_{22}$ carboxylic acid, a $C_{11}$-$C_{22}$ carboxylic acid, a $C_{14}$-$C_{22}$ carboxylic acid. Suitably the medium- or long-chain carboxylic acid is a long-chain fatty acid or a tall oil fatty acid. Suitable components include, without limitation, caprylic acid, capric acid, lauric acid, myristric acid, palmitic acid, stearic acid, arachidic acid, benehenic acid, myristoleic acid, palmitoleic acid, sapience acid, oleic acid, elaidic acid, vaccenic acid, linoleic acid, linoelaidic acid, α-linolenic acid, arachidonic acid, eicosapentaenoic acid, erucic acid, or docosahexanenoic acid.

The alkanolamide carrier comprises a compound of formula $RC(=O)(NR^1R^2)$ such as those prepared by the amidation of the alkanolamine and a medium- or long-chain carboxylic acid, such a fatty acid or a tall oil fatty acid. R comprises a linear or branched, saturated or unsaturated aliphatic group. R is suitably a $C_8$-$C_{22}$ alkyl or a $C_5$-$C_{22}$ alkenyl. $R^1$ and $R^2$ may be independently selected from hydrogen or an alkyl group, including, without limitation, a methyl, ethyl, propyl, or butyl group. The alkanolamide may be prepared from any of the alkanolamines and medium- or long-chain carboxylic acids described herein.

The anionic surfactant may comprise an alkylsulfonate, an alkylarylsulfonate, or the conjugate acid thereof. Exemplary sulfonated surfactants include, without limitation, a linear or branched, saturated or unsaturated $C_8$-$C_{20}$ alkylsulfonate or an alkylbenzesulfonate comprising a linear or branched, saturated or unsaturated $C_8$-$C_{14}$ alkyl group.

Concentrated oil additive may comprise between about 0.1% and about 25% of the BP by weight, but the amount of BP by weight may be lower when diluted with a base oil. This includes between about 0.1% and about 15% of the BP by weight, between about 0.1% and about 10% of the BP by weight, about 0.1% and about 8% of the oil additive by weight, or about 1% and about 5% of the oil additive by weight.

The BP may comprise between 0.1% and 20% of the boron component by weight and the balance the boron carrier. When the anionic surfactant is present, the BP may comprises between 0.1% and 20% of the boron component by weight, between about 0.1% and about 25% the anionic surfactant by weight, and the balance the boron carrier. When the carrier comprises an alkanolamine, the alkanolamine component may be present in an amount between about 1% and about 20% of the BP by weight or about 2% and about 15% of the BP by weight. If the anionic surfactant is present, the anionic surfactant may be present in an amount between about 5% and about 20% of the BP by weight or about 10% and about 15% of the BP by weight.

When the BP comprises the polymeric borate ion, the BP also comprises a counterion. For the purposes of determining weight percentages of the boron component and carrier, the weight of the counterion is included with the boron component.

When the BP comprises an alkylsulfonate or an alkylarylsulfonate, the BP also comprises a counterion. For the purposes of determining weight percentages of the boron component and carrier, the weight of the counterion is included with the alkylsulfonate or the alkylarylsulfonate component.

The oil additive may include any one, or any combination of, the following: a shear stable polymer, a dispersing agent, a base oil, a glycol, or a carboxylic acid for adjusting the total acid number. In some embodiments, all of these components are present in the additive.

The carboxylic acid for adjusting the total acid number may be a $C_6$-$C_{16}$ carboxylic acid. In some embodiments, the carboxylic acid comprises a $C_7$-$C_{10}$ carboxylic acid. Examples include, without limitation, heptanoic acid, octanoic acid, and neodecanoic acid. The additive may comprise between about 0.1% and about 25% of the carboxylic acid for adjusting the total acid number. This includes between about 0.1% and about 20%, about 0.1% and about 10%, or about 0.1% and about 5% of the carboxylic acid for adjusting the total acid number. The carboxylic acid for adjusting the total acid number may be the same or different from the carboxylic acid of the BiP.

The shear stable polymer may be added to reduce wear. In some embodiments, the shear stable polymer comprises a double-comb polymer such those prepared from the polymerization of alpha-olefins and dicarboxylic acids. Exemplary polymers of this type include, without limitation, Ketjenlube 115, Ketjenlube 135, or Ketjenlube 165. The additive may comprise between 0.1% and 25% of the shear stable polymer. This includes between about 0.5% and 20% or 1% and 10% of the shear stable polymer.

The dispersing agent may be added to minimize sludge and deposits. Exemplary dispersing agents include, without limitation, Dorf Kettle PX 4005, Dorf Kettle PX 4006, or Infinium 9232. The additive may comprise between about 0.1% and about 25% of the dispersing agent. This includes between about 0.5% and about 20% or about 1% and about 10% of the dispersing agent polymer.

The base oil to be employed in the additive formulation serves as a diluent and increases the fluidity of the additive. The base oil can be a petroleum-based oil, such as a naphthenic or paraffinic oil, a synthetic base stock, or silicone oil. The oil may be any suitable group of oil such as a Group I, Group II, Group III, Group IV, or Group V oil. The oil additive may comprise between about 0.1% and about 95% oil by weight.

Combination oil products may comprise one or more of any of the base oils described herein.

The glycol may be added to adjust the viscosity of the oil additive. Suitably, the glycol may be ethylene glycol, propylene glycol, hexylene glycol, or an alkyl ether of the foregoing. Exemplary alkyl ethers include, without limitation, ethylene glycol monomethyl ether, ethylene glycol monoethyl ether; ethylene glycol monopropyl ether; ethylene glycol monoisopropyl ether; ethylene glycol monobutyl ether; ethylene glycol monophenyl ether; ethylene glycol monobenzyl ether; propylene glycol methyl ether, diethylene glycol monomethyl ether; diethylene glycol monoethyl ether, diethylene glycol mono-n-butyl ether, dipropyleneglycol methyl ether, dialkyl ethers (such as ethylene glycol dimethyl ether, ethylene glycol diethyl ether, or ethylene glycol dibutyl ether), or esters (such as ethylene glycol methyl ether acetate; ethylene glycol monoethyl ether acetate; ethylene glycol monobutyl ether acetate, or propylene glycol methyl ether acetate).

The additive composition is intended to be incorporated in a wide variety of oils to prepare combination oil products. Suitable oils for use to prepare combination oil products include, without limitation, motor oil, transmission fluid, hydraulic fluid, gear oil, penetrating oil, and the like. The oil additive may is used in varying amounts depending upon the particular oil with which it is incorporated. Suitably the oil additive is used in an effective amount. In general, the additive is used in the amount of about 0.2 to about 5.0 ounces of additive per quart of oil or fluid, including in amount from about 0.2 to about 4.0 or about 0.2 to about 0.4 ounces of additive per quart of oil or fluid. With a motor oil, the additive is used in the amount of about 0.2 to about 5.0 ounces of additive per quart of motor oil, including in amount from about 0.2 to about 4.0 or about 0.2 to about 0.4 ounces of additive per quart of motor oil. With transmission fluid, the additive is incorporated in an amount of about 0.3 to about 1.0 ounces of additive per quart of transmission fluid. When used with gear oil, the additive is preferably used in an amount of about 0.5 to about 2.0 ounces per quart of gear oil.

Miscellaneous

Unless otherwise specified or indicated by context, the terms "a", "an", and "the" mean "one or more." For example, "a molecule" should be interpreted to mean "one or more molecules."

As used herein, "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≤10% of the particular term and "substantially" and "significantly" will mean plus or minus >10% of the particular term.

As used herein, the terms "include" and "including" have the same meaning as the terms "comprise" and "comprising." The terms "comprise" and "comprising" should be interpreted as being "open" transitional terms that permit the inclusion of additional components further to those components recited in the claims. The terms "consist" and "consisting of" should be interpreted as being "closed" transitional terms that do not permit the inclusion additional components other than the components recited in the claims. The term "consisting essentially of" should be interpreted to be partially closed and allowing the inclusion only of additional components that do not fundamentally alter the nature of the claimed subject matter.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

All references, including publications, patent applications, and patents, cited herein are hereby incorporated by reference to the same extent as if each reference were individually and specifically indicated to be incorporated by reference and were set forth in its entirety herein.

Preferred aspects of this invention are described herein, including the best mode known to the inventors for carrying out the invention. Variations of those preferred aspects may become apparent to those of ordinary skill in the art upon reading the foregoing description. The inventors expect a person having ordinary skill in the art to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

EXAMPLES

Example 1: Preparation of an Oil Additive

An oil additive according to the invention was prepared from the following components:

(i) 70% by weight of a BiP premix comprising between 15-30% by weight bismuth trioxide by weight and a balance of a linear or branched $C_7$-$C_{10}$ carboxylic acid;

(ii) 0.1-8% by weight of a BP premix comprising between 1-20%-by weight boric acid, 10-15% weight of an anionic surfactant, a balance boron carrier comprising 10% by weight of the BP premix monoethanolamine and;

(iii) 5% by weight of a dispersing agent;

(iv) 5% by weight of a shear stable double comb polymer;

(v) 5% by weight of a $C_7$-$C_{10}$ carboxylic acid to adjust total acid number; and (vi) a balance of Group III oil.

The additive components listed above were added to a mixing tank and heated to about 120 degrees F. The mixture was agitated at around 500 r.p.m. for 30 minutes or until most of the off gassing ceases. Finished product was a golden color that is crystal clear.

Example 2: Shelf-Life Stability Testing

The oil additive according to Example 1 was visually monitored for stability over a period of six months. The additive maintained its crystal clear, golden appearance with no indication of product separation or salting out.

Example 3: Preparation of a Combination Oil Product Comprising an Effective Amount of the Additive The oil additive according to Example was combined with a Group III motor oil at a ratio of 1 once additive per 1 quart motor oil mixed via an oil pump.

Example 4: Timken Load Testing

The combination product according to Example 3 was evaluated by a portable load-testing machine. The combination product had a 3-400 times better performing than the untreated motor oil that underwent the same testing.

Example 5: Dynamometer Testing

The combination product according to Example 3 was evaluated for maximum horsepower and torque output from a 2018 Indian Chieftain motorcycle on a dynamometer in comparison to the untreated synthetic oil. The motorcycle with untreated synthetic oil was run according to industry standard dynamometer testing procedures. This established baseline horsepower, torque, and heat. The motorcycle was shut down and the engine allowed to cool. The untreated oil was then treated with the composition according to Example 1 to prepare the combination product of Example 3. The motorcycle was run for 1 hour to ensure the treated oil circulated throughout the lubrication system. The motorcycle was then rerun according to the same dynamometer testing procedures. The combination product resulted in an increase in maximum horsepower and torque relative to the untreated oil.

Representative trials are shown in Table 1 and FIGURE shows the power and torque testing for representative trial #2. As shown in the FIGURE, the motorcycle employing the a combination oil product comprising the oil additive 20 reaches a higher maximum horsepower (HP) than the same motorcycle employing a motor oil without the oil additive 10. Similarly, the motorcycle employing the combination oil product comprising the oil additive 40 reaches a higher maximum torque than the same motorcycle employing a motor oil without the oil additive 30.

TABLE 1

Comparison of maximum horsepower (HP) and torque

| Product | Max. HP | % gain | Max. torque (ft/lb) | % gain |
|---|---|---|---|---|
| Representative Trial 1 | | | | |
| Example 3 | 78.60 @ 4990 RPM | 6.3 | 107.08 @ 2660 RPM | 2.3 |

TABLE 1-continued

Comparison of maximum horsepower (HP) and torque

| Product | Max. HP | % gain | Max. torque (ft/lb) | % gain |
|---|---|---|---|---|
| Base oil | 73.92 @ 4480 RPM | | 104.63 @ 2620 RPM | |
| Representative Trial 2 | | | | |
| Example 3 | 77.95 @ 4880 RPM | 7.4 | 109.48 @2530 RPM | 6.8 |
| Base oil | 72.56 @4420 RPM | | 102.50 @2760 RPM | |

Example 6: Thermal Testing

The combination product according to Example 3 was evaluated for operating temperature of 2018 Indian Chieftain motorcycle as described in Example 5, Trial 1. The motorcycle running with the oil additive operated at a temperature lower than the same motorcycle running without the oil additive.

TABLE 2

Comparison of operating temperature

| Product | Temp. (° F.) | Difference (° F.) |
|---|---|---|
| Example 3 | 226 | −31 |
| Base oil | 257 | |

I claim:

1. An oil additive comprising:

a bismuth-containing premix, the bismuth-containing premix comprising bismuth trioxide and a bismuth carrier, a boron-containing premix, the boron-containing premix comprising boric acid, a boron carrier, and an anionic surfactant, and optionally a component selected from the group consisting of a shear stable polymer, a dispersing agent, a carboxylic acid for adjusting the total acid number, a glycol, and any combination thereof, wherein the bismuth carrier comprises a linear or branched, saturated or unsaturated $C_6$-$C_{16}$ carboxylic acid, a conjugate base thereof, or a combination thereof and wherein the boron carrier comprises an alkanolamine, a linear or branched, saturated or unsaturated $C_8$-$C_{22}$ carboxylic acid or a conjugate base thereof, an alkanolamide, or any combination thereof.

2. The oil additive of claim 1, wherein the bismuth carrier comprises a linear or branched, saturated or unsaturated $C_7$-$C_{10}$ carboxylic acid, a conjugate base thereof, or a combination thereof.

3. The oil additive of claim 2, wherein the boron carrier comprises an alkanolamine and a linear or branched, saturated or unsaturated $C_{11}$-$C_{22}$ carboxylic acid or a conjugate base thereof.

4. The oil additive of claim 3, wherein the alkanolamine comprises a monoalkanolamine.

5. The oil additive of claim 1, wherein the anionic surfactant comprises an alkylsulfonate, an alkylarylsulfonate, or the conjugate acid thereof.

6. The oil additive of claim 1, wherein the oil additive comprises the shear stable polymer.

7. The oil additive of claim 6, wherein the shear stable polymer is a double comb polymer.

8. The oil additive of claim 1, wherein the oil additive comprises the dispersing agent.

9. The oil additive of claim 1, wherein the oil additive comprises the glycol.

10. The oil additive of claim 9, wherein the glycol is ethylene glycol, propylene glycol, hexylene glycol, or an alkyl ether of the foregoing.

11. The oil additive of claim 1, wherein the oil additive comprises the carboxylic acid for adjusting the total acid number.

12. The oil additive of claim 1, wherein the oil additive further comprises a base oil.

13. The oil additive of claim 12, wherein the base oil is a Group III oil.

14. The oil additive of claim 1, wherein the oil additive comprises the shear stable polymer, the dispersing agent, the glycol, and the carboxylic acid for adjusting the total acid number.

15. The oil additive of claim 1, wherein the oil additive comprises 50% and 99% bismuth-containing premix by weight and 0.1% and 25% boron-containing premix by weight.

16. A combination oil product comprising an oil and an effective amount of the oil additive of claim 1.

17. A combination oil product comprising an oil and an effective amount of the oil additive of claim 3.

18. An oil additive comprising a bismuth-containing premix, the bismuth-containing premix comprising bismuth trioxide and a bismuth carrier;

a boron-containing premix, the boron-containing premix comprising boric acid, a boron carrier, and an anionic surfactant comprising a sulfonate group;

a carboxylic acid for adjusting the total acid number;

a shear stable polymer;

a dispersing agent; and a base oil, wherein the bismuth carrier comprises a linear or branched, saturated or unsaturated $C_7$-$C_{10}$ carboxylic acid, a conjugate base thereof, or a combination thereof and wherein the boron carrier comprises a monoalkanolamine and a linear or branched, saturated or unsaturated a $C_{11}$-$C_{22}$ carboxylic acid carboxylic acid or a conjugate base thereof.

19. The oil additive of claim 18, wherein the oil additive further comprises a glycol.

20. A combination oil product comprising an oil and an effective amount of the oil additive of claim 18.

* * * * *